US009289776B2

(12) United States Patent
Virdis et al.

(10) Patent No.: US 9,289,776 B2
(45) Date of Patent: Mar. 22, 2016

(54) MILLING DEVICE WITH ADJUSTABLE MILLING OPERATION

(71) Applicant: Frewitt Fabrique de Machines SA, Granges-Paccot (CH)

(72) Inventors: Antoine Virdis, Ferpichoz (CH); Xin Gao, Fribourg (CH)

(73) Assignee: FREWITT FABRIQUE DE MACHINES SA, Granges-Paccot (CH)

( * ) Notice: Subject to any disclaimer, the term of this patent is extended or adjusted under 35 U.S.C. 154(b) by 490 days.

(21) Appl. No.: 13/736,302

(22) Filed: Jan. 8, 2013

(65) Prior Publication Data

US 2013/0119172 A1 May 16, 2013

Related U.S. Application Data

(63) Continuation of application No. PCT/EP2010/059872, filed on Jul. 9, 2010.

(51) Int. Cl.

| | |
|---|---|
| ***B02C 25/00*** | (2006.01) |
| ***B02C 4/26*** | (2006.01) |
| ***B02C 4/42*** | (2006.01) |
| ***B02C 18/06*** | (2006.01) |
| ***B02C 18/26*** | (2006.01) |

(52) U.S. Cl.

CPC . *B02C 25/00* (2013.01); *B02C 4/26* (2013.01); *B02C 4/42* (2013.01); *B02C 18/062* (2013.01); *B02C 18/26* (2013.01)

(58) Field of Classification Search

CPC ..... B02C 25/00; B02C 13/284; B02C 23/16; B02C 23/10

USPC ..... 241/33, 36, 37, 189.1, 73, 89.3, 88.4, 241/89.1

See application file for complete search history.

(56) References Cited

U.S. PATENT DOCUMENTS

| | | | | |
|---|---|---|---|---|
| 4,489,896 | A * | 12/1984 | Cerroni | 241/36 |
| 4,603,816 | A | 8/1986 | Panning | |
| 7,077,345 | B2 * | 7/2006 | Byram et al. | 241/35 |
| 7,222,805 | B1 * | 5/2007 | Williams, Jr. | 241/89.1 |

(Continued)

FOREIGN PATENT DOCUMENTS

| | | |
|---|---|---|
| CH | 348599 | 10/1960 |
| EP | 0785025 A1 | 7/1997 |

OTHER PUBLICATIONS

International Search Report for PCT/EP2010/059872 dated May 6, 2011.

*Primary Examiner* — Faye Francis
(74) *Attorney, Agent, or Firm* — Pearne & Gordon LLP

(57) ABSTRACT

A milling device for performing a milling operation comprising a milling unit comprising a housing defining a milling chamber that can be filled with a material to be milled, a rotor assembly rotatably mounted in the housing, and a screen assembly for fractionating the material milled by the rotor assembly in movement and extending below the rotor assembly; and a drive unit adapted for controlling the movements of the rotor assembly relative to the screen assembly during the milling operation; wherein said drive unit is configured to produce an oscillating movement of the rotor assembly, the oscillating movement having an oscillation angle that can be varied during the milling operation when controlling the movements of the rotor assembly relative to the screen assembly. The milling device has improved milling efficiency.

11 Claims, 6 Drawing Sheets

(56) References Cited

U.S. PATENT DOCUMENTS 8,960,577 B2 * 2/2015 Tjell et al. ..... 241/30
2007/0241216 A1 * 10/2007 Wada et al. ..... 241/36
2014/0166791 A1 * 6/2014 Tjell et al. ..... 241/30
2014/0263777 A1 * 9/2014 Anderson, Jr. ..... 241/30

* cited by examiner

MILLING DEVICE WITH ADJUSTABLE MILLING OPERATION

FIELD

The present invention concerns a milling device for performing a milling operation, and more particularly to a milling device that facilitates highly efficient milling with an adjustable milling operation.

BACKGROUND

In conventional oscillating mills, the material to be milled is ground between a rotating rotor assembly and a sieve. The desired properties of the milled material, such as particle grain size and particle flow rate, can be obtained by adequately selecting appropriate milling parameters such as the rotation speed of the rotor assembly and/or the oscillation amplitude and frequency in the case rotor assembly is oscillated. The correct selecting of appropriate milling parameters is also critical in avoiding important rise in temperature that could be detrimental to the quality of the milled material. During most milling operation, however, it can be difficult to select milling parameters that are appropriate during the whole milling operation. Indeed, during milling, the material can change its properties, for example due to increased temperature and/or humidity, rendering the milling parameters inadequate. For example, the milling parameters initially selected can cause the milling device to effectively mill the material to a given grain size after a give milling time, but the milled material having too large a grain size non-uniformity. To obtain acceptable grain size uniformity may require changing the milling parameters at that time of the milling operation. With such conventional milling device, however, the milling parameters cannot be simply changed during the milling operation.

In document WO2008028870, a milling device, particularly a disk vibration mill comprising a grinding gear and an oscillating drive, with which the grinding gear can be excited to the vibrations depending on the driving rotational speed. In order to improve the milling efficiency, the driving rotational speed during operation of the vibration mill (1) is varied in a predetermined manner. In U.S. Pat. No. 4,603,816, an attritor for solids comprises a cylindrical milling vessel comprising a rotor which rotation velocity can alternately pass from a relatively high speed to a relatively low speed.

In U.S. Pat. No. 4,603,816, an apparatus for shredding waste material includes first and second cooperating shredding rotors rotatably mounted adjacent to one another in a shredding chamber. The rotors are oscillated out of phase with one another and a crank drive arrangement allows for varying the rotational amplitude of the oscillation movement.

Document CH348599 discloses an apparatus for grinding hard grains and comprising a screen, a rotor forming a cavity to be fed with material for grinding. The apparatus further comprises a crank mechanism which reciprocates the rotor in a circular oscillatory motion with respect to the screen.

In the above cited prior art, the change in motion, such as rotational speed and/or rotational amplitude, cannot be varied according to the properties of the material being milled.

SUMMARY

The present application discloses a milling device which overcome at least some limitations of the prior art.

According to the embodiments, a milling device for performing a milling operation comprising a milling unit comprising a housing defining a milling chamber that can be filled with a material to be milled, a rotor assembly rotatably mounted in the housing, and a screen assembly for fractionating the material milled by the rotor assembly in movement and extending below the rotor assembly; and a drive unit adapted for controlling the movements of the rotor assembly relative to the screen assembly during the milling operation; wherein said drive unit further comprises: a sensor for measuring properties of the material being milled during the milling operation; and a control module adapted to determine and adjust milling parameters during the milling operation in accordance with the properties of the material measured by the sensor, such that said controlling the movement of the rotor assembly is performed during the milling operation in accordance with the properties of the material.

In an embodiment, said movements of the rotor assembly comprise an oscillating movement having an oscillation angle that can be varied during the milling operation.

In another embodiment, said drive unit is further configured such that the oscillating movement comprises an oscillation frequency that can be varied during the milling operation.

In yet another embodiment, said drive unit is further configured such that said oscillation angle can be shifted by a shift angle at each oscillation during the milling operation.

In yet another embodiment, said shift angle can be varied during the milling operation.

In yet another embodiment, said drive unit is further configured to produce a rotational movement of the rotor assembly with a rotation speed that can be varied during the milling operation.

In yet another embodiment, said drive unit is further configured to produce a translational movement of the rotor assembly and/or the screen assembly such that the distance between the rotor assembly and the screen assembly can be varied during the milling operation.

In yet another embodiment, the sensor can be a multi-parameter sensor based on laser spatial filter velocimetry.

In yet another embodiment, the drive unit can further comprise a motor control unit connected to the control module for driving the rotor assembly.

In yet another embodiment, the sensor can be mounted in the milling chamber.

The present disclosure also pertains to a method comprising:

moving the rotor assembly relative to the screen assembly according to a first predetermined milling parameter controlling the movements of the rotor assembly by producing an oscillating movement of the rotor assembly with a first oscillation angle;

measuring properties of the material being milled using the sensor; and determining and adjusting said milling parameter in accordance with the properties of the material measured by the sensor, such that the oscillation angle is varied during the milling operation in accordance with the properties of the material being milled.

The milling device and method disclosed herein allow for adjusting the milling parameters, i.e., controlling the movements of the rotor assembly, in accordance with the properties of the material being milled. This in turn allows for improving the milling efficiency.

BRIEF DESCRIPTION OF THE DRAWINGS

The invention will be better understood with the aid of the description of an embodiment given by way of example and illustrated by the figures, in which.

DETAILED DESCRIPTION OF THE PREFERRED EMBODIMENTS

Figure 1:
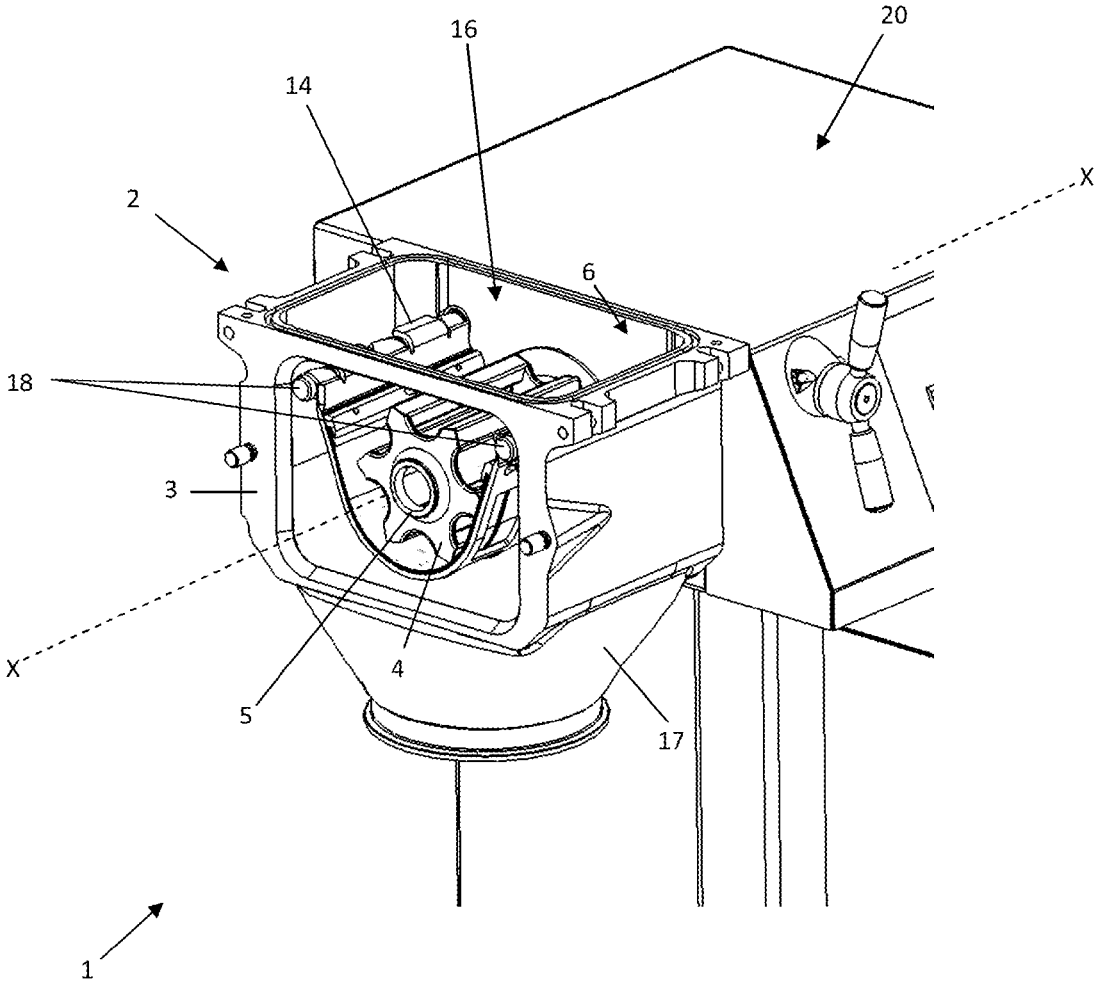
FIG. 1 shows a perspective view of a milling device comprising a milling unit formed from a rotor assembly and a screen assembly, and a drive unit according to an embodiment.
Figure 2:
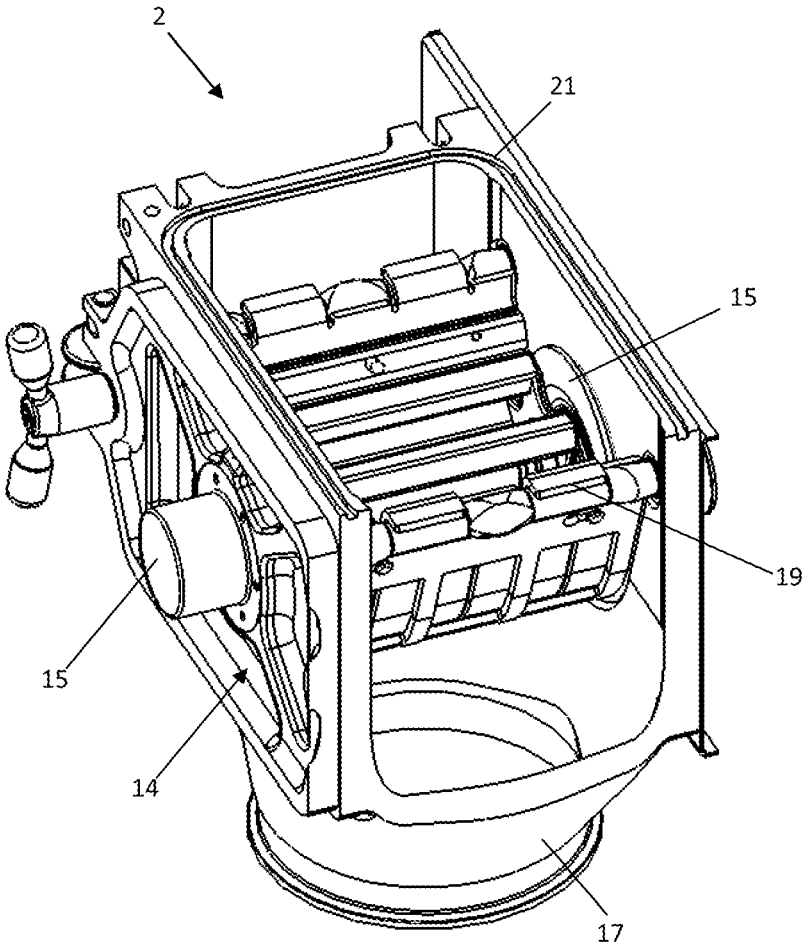
FIG. 2 represents an isolated view of the milling unit according to an embodiment.

FIG. 1 shows a perspective view of a milling device 1 according to an embodiment. The milling device 1 comprises a milling unit 2 containing a housing 3 in which a rotor assembly 4 is rotatably mounted about a horizontal axis x-x from a wall 6 of the milling device 1. The housing 3 encloses a milling chamber 16 that can be filled with the material to be milled. In FIG. 1, the milling unit 2 is schematically represented connected to a drive unit 20 destined to drive the rotor assembly 4 via a rotor shaft 5. In FIG. 2, representing an isolated view of the milling unit 2, the housing 3 is shown with a front door 14 that can be pivotally open or removed from the housing 3. In FIG. 2, the housing 3 is shown without one of its side wall and being open at its top in order to better display the different parts of the milling unit 2. However, the top of the housing 3 can comprise a hood (not represented) that can be fixed to the housing 3 by screwing or any other means. The front door 14 and hood can be sealingly fitted to the housing 3 by using a seal, for example, in the form of an o-ring seal 21 such as the one shown in the FIGS. 1 and 2. The milling device 1 further comprises a U-shaped screen assembly 13 extending below the rotor assembly 4 along the horizontal axis such as to surround the lower half of the rotor assembly 4.

Figure 3:
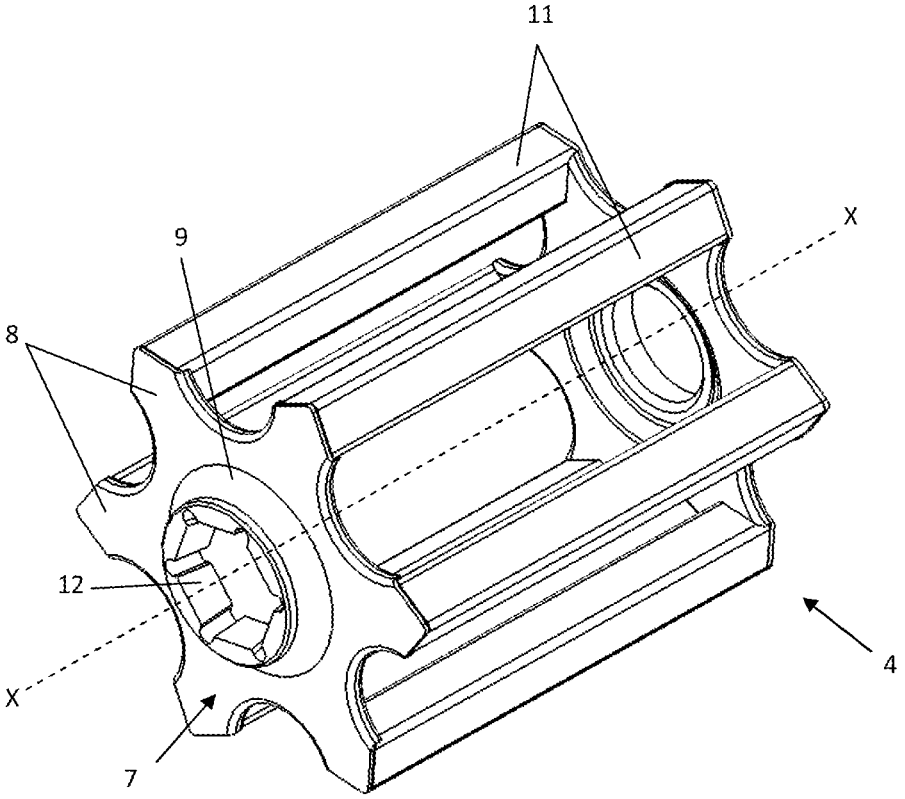
FIG. 3 shows a detailed view of the rotor assembly according to an embodiment.

A detailed view of the rotor assembly 4 is shown in FIG. 3 according to an embodiment. In the example of FIG. 3, the rotor assembly 4 comprises a pair of end discs 8 on which are mounted a plurality of longitudinal blades 11 extending between the two end discs 8. More particularly, the end discs 8 are provided with six spokes 8 on which the blades 11 are mounted, each six spoke 8 being evenly disposed around the discs 7 and separated by arcuate recesses 10. The recesses 10 can help to channel the flow of the material being milled. Each end disc 8 of the rotor assembly 4 is provided with a pair of central bushing 9.

In an embodiment, the rotor assembly 4 can be drivingly connected to the rotor shaft 5 by engaging the rotor shaft 5 through the two central bushings 9. The rotor assembly 4 can be rotationally locked to the rotor shaft 5 by using a conventional key or spline bushing inner periphery 12 as shown in FIG. 2. When connected to the rotor shaft 5, the rotor assembly 4 can be rotated about its horizontal axis x-x. In the example of FIG. 2, the rotor assembly 4 is drivingly mounted on the shaft 5 and is journaled in bushing arrangements 15, located in the wall of the drive unit 20 and in the front door 14. In this arrangement, the bushing arrangement 15 in the front door 14 supports and guides the rotor shaft 5, providing a stable connection of the rotor assembly 4 in the milling unit 2 that is appropriate for large milling units 2. Alternatively, the rotor assembly 4 can be mounted on the shaft 5 being journaled only in the wall of the drive unit 20, in such a way as to be cantilevered from wall of the drive unit 20. This latter configuration can provide a simpler and is adequate for a small-sized milling unit 2. The rotor shaft 5 can be hermetically sealed relative to the housing 3 by at least one shaft seal (not shown) at an end wall 16 of the housing.

Other configurations of the rotor assembly 4 are also possible provided the rotor can be removably connected to the rotor shaft 5. For example, the rotor assembly 4 can comprise a number of blades 11 different from six. The blades 11 can have a quadrilateral or circular cross section or have a cross section with complex shape. In a preferred embodiment, the blades 11 have a quadrilateral cross section with different pairs of angles (lozenge), for example with pairs of angles of 100° and 80°.

Figure 4:
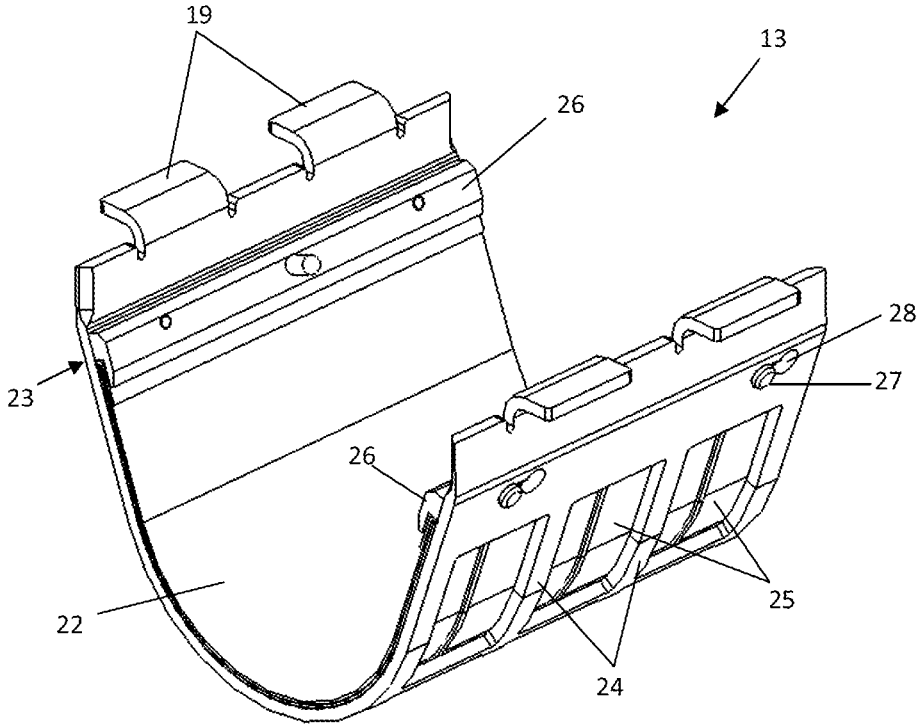
FIG. 4 illustrates a detailed embodiment of the screen assembly.

FIG. 4 illustrates a detailed embodiment of the screen assembly 13. The screen assembly 13 includes a rigid screen support structure 23 having a plurality of ribs 24 defining a plurality of apertures 25, the screen support structure 23 having a curved U-shaped form. A screen 22 is adjusted on the screen support structure 23 and fixed to it by using flanges 26 that can be attached at the two opposite ends of the screen support structure 23. In the example of FIG. 4, the flanges comprise engaging pins 27 that can be inserted in respective slots 28 of the screen support structure 23 to attach the flanges 26. When fixed, the screen 22 conforms to the shape of the screen support structure 23. This arrangement provides considerable support to the screen 22 against deformation. It also provides an effective mechanism for quickly and easily replacing the worn screen 22. The curvature of the U-shaped screen support structure 23 can be such that the screen 22, when adjusted the support structure 23, conforms the cylindrical curvature of the rotor assembly 4.

Other detachably fixing means can be used for fixing the screen 22 to the screen support structure 23 as long as the screen 22 can be adjusted onto the support structure 23 such that the screen 22 conforms to the shape of the screen support structure 23.

In a preferred embodiment, the screen support structure 23 can be removably mounted within the housing 3. In the configuration of FIGS. 1 and 4, the screen support structure 23 is hung on two rods 18 fixed on the housing 3 and extending on each side of the rotor assembly 4, by latch portions 19 extending from each lateral end of the support structure 23. Other arrangements for removably mounting the screen support structure 23 are also possible in so far as the support structure 23 is disposed around the lower half of the rotor 4, substantially parallel with the rotation axis x-x of the rotor assembly 4. Alternatively, the screen 22 can be removably mounted directly within the housing 3 without the screen support structure 23. In this configuration, the flexible screen 22 is likely to be deformed when the rotor assembly 4 is rotated and/or oscillated. The deformation movements of the screen can be advantageous for declogging the product being milled, for example in the case product is humid. The screen 22 can comprise a square wire mesh or round wire mesh or have a rasp-like structure. Square wire mesh can be used for fragmentation and dry sizing, where the material is fragmented on the edge of the square mesh wire, while round wire mesh can be used for wet sizing. Round wire mesh can have a very fine wire relative to the mesh size.

In an embodiment, the distance between the rotor assembly 4 and the screen assembly 13 can be varied. This can be performed by moving in translation the rotor assembly 4, or rotor shaft 5. Alternatively the distance is varied by moving in translation the screen support structure 23, for example, by lowering or elevating the two rods 18, by moving the screen 22 itself, or by changing the tension of the screen 22 in the support structure 23. In the embodiments described above, rotor assembly 4 and screen assembly 13 are removably mounted in the milling unit 2 and can be easily readily accessed within the milling chamber 16, allowing for rapid exchanging the sizing tools 4, 13 in just a few steps. For example, the milling unit 2 can be provided with a rotor having a different diameter and/or a different number of blades 11 and/or shapes, for different type of milling.

The material to be milled can be added to the milling chamber 16 from above. Prior to the milling operation, the housing 3 can be closed by a hood door (not represented). The front door 14 and the hood can be sealed to the housing 3. The housing can also be arranged such that the milling chamber 16 is sealed such that dust produced by the milling process does not exit the milling chamber 16. An inlet funnel (not shown) can be added to the top of housing 3 to facilitate the filling if the material to be filled into the milling chamber 16. The screen 22 serves for fractionating the material milled by the rotor assembly 4 in movement. The milled materials are then removed below the milling chamber 16, through the screen 22 and down through an outlet funnel 17 attached to the lower part of the housing 3. In an alternative of the embodiment, a dust-tight protection can be connected between the outlet funnel 17 and a container destined to receive the milled material coming out of the milling unit 2, such as to prevent product contamination. For example, this dust-tight protection can be a Profi-Bant® as sold by Frewitt SA.

Figure 5:
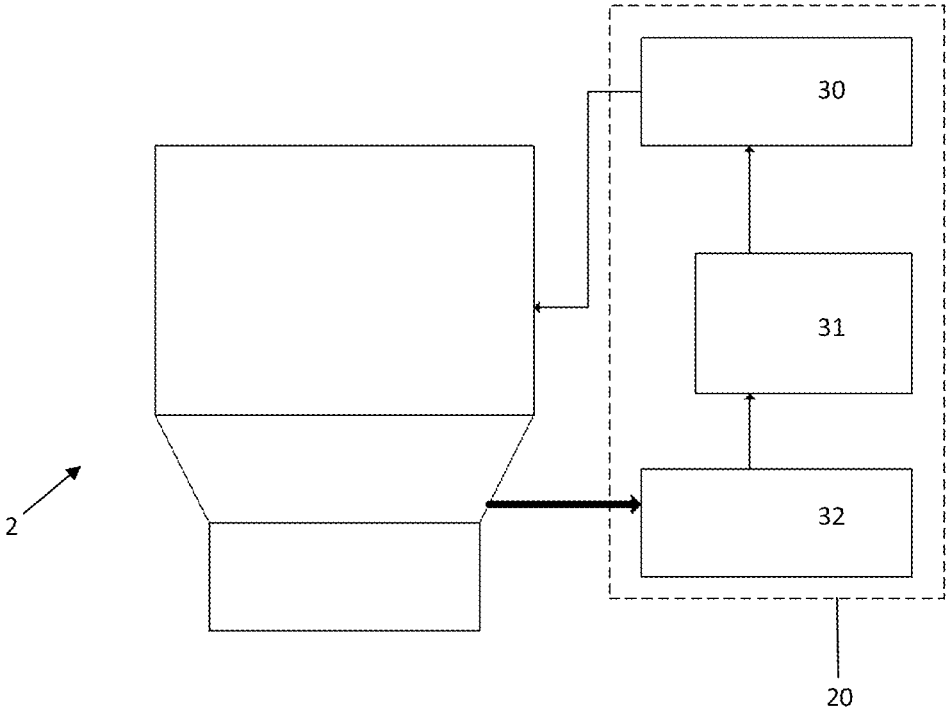
FIG. 5 represents schematically the drive unit according to an embodiment.

In an embodiment represented schematically in FIG. 5, the drive unit 20 comprises a motor drive module 30 adapted to drive the rotor assembly 4 via the rotor shaft 5 relative to the screen 22. The motor drive module 30 can further comprise a transmission (not shown) for driving the rotor shaft 5 such as a planetary gear transmission which enables shifting under full load between the lower speed and the higher speed. The drive module 30 can be further adapted to drive the screen assembly 13, as discussed above. In a preferred embodiment, the drive unit 20 further comprises a sensor 32 for measuring properties of the material being milled. Preferably, the sensor is a multi-parameter sensor 32 arranged to measure adapted to measure in situ and in real time during the milling operation at least one parameter of the material being milled comprising particle size distribution, number of particles, flow rate, and temperature, or a combination of any of them. The sensor 32 can be a PAT sensor, for example such as the one provided by Parsum GmbH and based on laser spatial filter velocimetry. The sensor 32 is preferably mounted within the milling chamber 16, for example under the screen 22. The sensor 32 delivers a sensor signal representative of the parameter measurements and can be sent to a control module 31.

The control module 31 is adapted to determine and/or adjust milling parameters based on the sensor signals. The milling parameters determined in the control module 31 are then used to control the motor drive module 30 driving the rotor shaft 5 such that the movements of the rotor assembly 4 are controlled in accordance to the milling parameters in order to optimize the milling operation. The above configuration thus allows for adjusting the milling parameters in accordance with the condition of the material being milled, measured by the sensor 32, and control the movements of the rotor assembly 4 in real time during the milling operation, to achieve the optimal milling performance. For example, the control module 31 can determine upper and lower limits in the milling parameters. The control module 31 can comprise a processing module such as an adequately programmed digital processor or DSP or a general purpose microcontroller.

Figure 6:
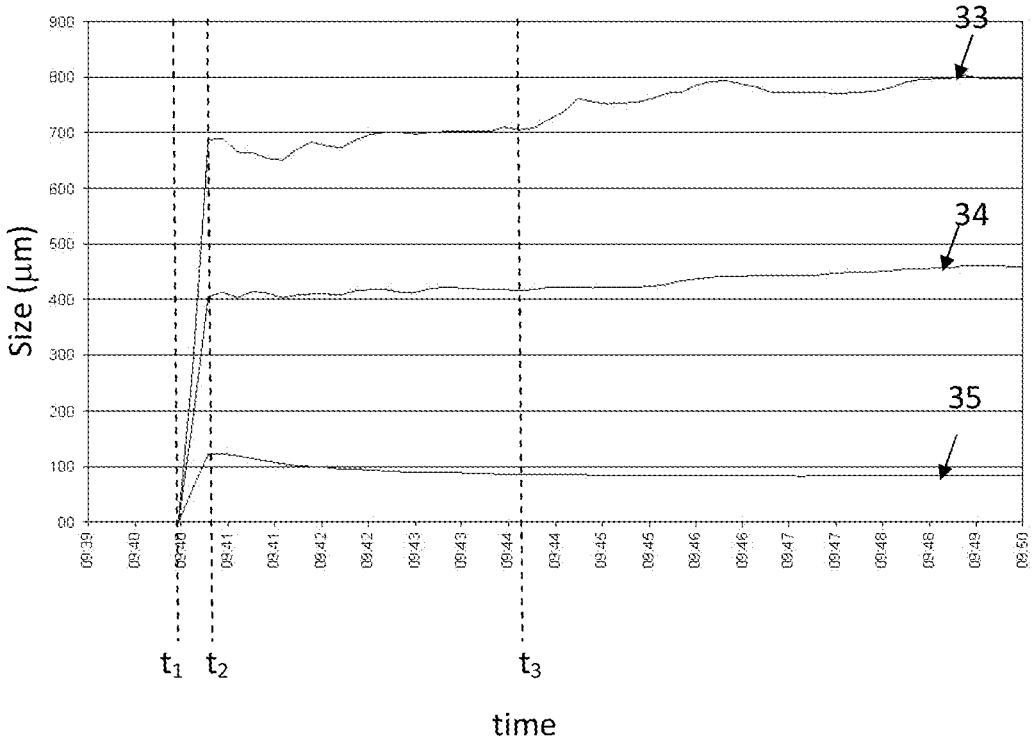
FIG. 6 represents a graph where the particle size is plotted against the milling time during a milling operation in the milling device in an exemplary embodiment.

In FIG. 6, the particle size of the material being milled is plotted against the milling time during a milling operation in the milling device 1 disclosed herein. More particularly, curves are shown for material to be milled to a particle size D90 of 800 μm (curve 33), D50 of 500 μm (curve 34), and D10 of 100 μm (curve 35). Here, the expression particle size D90, D50 and D10 stands for 90, 50 and 10 mass-% of the particles having an equivalent diameter smaller than 800 μm, 400 μm and 100 μm, respectively; and the other 10, 50 and 90 mass having an equivalent diameter larger than 800 μm, 400 μm and 100 μm, respectively. At an initial time $t_1$ the milling operation is started with the rotor shaft 5 being rotated at an initial rotation speed RS. After a short time period ($t_2$), a particle size D90 of 700 μm is measured by the sensor 32. Since the measured sensor signal differs from the set point corresponds to the particle size value of 800 μm, the sensor signal delivered to the control module 31 results in adjusting the milling parameters controlling the motor drive module 30 such as to adapt the movements of the rotor assembly 4, to increase the particle size value. In the example of FIG. 6, this is achieved by increasing the initial rotation speed RS of the rotor shaft 5 at a third time t3. FIG. 6 shows that after increasing the speed of the rotor shaft 5, the measured particle size D90 increase and reaches a value of about 800 μm.

In an embodiment, movements of the rotor assembly 4 relative to the screen assembly 13 comprise a rotational movement of the rotor assembly 4 about the rotor shaft 5. Here, the drive unit 20 is configured to rotate the rotor assembly 4 at a rotation speed RS typically comprised between 0 and 200 rpm. This corresponds to a peripheral speed comprised between 0 mm/s and about 1350 mm/s for the rotor assembly 4 having a diameter of 160 mm. The rotation speed RS can be constant or varied during the milling operation.

In another embodiment, movements of the rotor assembly 4 comprise a rotary oscillating movement of the rotor assembly 4 about the rotor shaft 5. More particularly, the rotor assembly 4 is rotated back and forth about the rotor shaft 5 with a predetermined oscillation angle (angular amplitude). The predetermined oscillation angle OA can typically have a value comprised between 0 and 360°. In some cases, the assembly 4 can be rotary oscillated with a predetermined oscillation angle corresponding to more than 360° and even up to several complete rotations.

Preferably, the rotor assembly 4 is made to oscillate at an oscillation frequency OF that can is comprised between 0 and 4 Hz. The oscillation frequency OF can also be varied during the milling operation by increasing or decreasing the rotation speed of the rotor assembly 4 during the oscillatory movement. In a variant, a vibration-like movement of the rotor assembly 4 can be obtained in the case the rotor assembly 4 is rotary oscillated with a predetermined oscillation angle smaller than about 2°. The predetermined oscillation angle can be kept constant during the milling process or can be varied during the course of the milling process.

In yet another embodiment, movements of the rotor assembly 4 comprise shifting the oscillation angle of the rotor assembly 4 by a shift angle SA at each oscillation of the oscillating movement of the previous embodiment. Shifting the oscillation angle means that the angular position of the rotor assembly 4 is shifted by the value of the shift angle after completing a rotary oscillating movement. The shift angle has a value that is typically comprised between 0 and 90°. In a variant of this embodiment, the shift angle is varied during the milling operation. In a variant of the embodiment, the shift angle SA is varied during the milling operation.

In yet another embodiment, movements of the rotor assembly 4 relative to the screen assembly 13 comprise the translational movement of the rotor assembly 4 or the screen 22 such that the distance between the rotor assembly 4 and the screen assembly 13 can be varied.

The movements of the rotor assembly 4 described above can be adjusted by the drive unit 20 according to the milling parameters based on the signals delivered by the sensor 32. Thus, the movements of the rotor assembly 4 can then be adjusted according to the properties of the material being milled during the milling operation.

The present disclosure also comprises a method the operation of the milling device 1 comprising the steps of:

feeding the material to be milled into the milling chamber 16;

initiating the milling operation by moving the rotor assembly 4 relative to the screen assembly 13 according to a predetermined milling parameter;

delivering a sensor signal using the sensor 32, the sensor signal comprising information related to the properties of the material being milled; and adjusting the milling parameter according to the sensor signal.

In an embodiment, moving the rotor assembly 4 relative to the screen assembly 13 according to a predetermined milling parameter comprises producing an oscillating movement of the rotor assembly 4 about the rotor shaft 5 with a oscillation angle OA and oscillation frequency OF of the rotor assembly 4; a rotational movement of the rotor assembly 4 with a rotation speed RS; the translational movement of the rotor assembly 4 or the screen assembly 13, or a combination of any of them.

In another embodiment, adjusting the milling parameter comprises varying the oscillation angle OA and/or frequency OF of the rotor assembly 4, shifting the oscillation angle of the rotor assembly 4 by a shift angle SA at each oscillating movement, varying the shift angle, varying the rotation speed RS of the rotor assembly 4, varying the distance between the rotor assembly 4 and the screen assembly 13, or a combination of any of them. Since the sensor 32 measures in real time the properties of the material being milled, the step of adjusting the milling parameter can be repeated many times during the milling operation and, thus, the variation of the rotor movements. In an embodiment, the milling parameter measured by the sensor 32 comprises one of the particle size distribution, number of particles, temperature of the material being milled, particle flow rate, or a combination of any of them.

In accordance with an aspect of the invention, there is provided a computer program product configured to be operable in the control module 31, in order to carry out the processing of the delivered sensor signal in order to determine and/or adjust the milling parameters and control the motor drive module 30 and the movements of the rotor assembly 4 in accordance to the milling parameters. The processing is performed according to the method described above when the program is executed by the control module 31. The software product can be downloaded in a memory (not shown) associated with the control module 31. The downloading operation can be performed using a storage reader device (not shown), such as a CD or DVD reader, etc., integrated on the drive unit 20, or an removable storage reader device (not shown), such as an external CD or DVD reader, a USB memory key or a flash memory, connected to the drive unit 20 or removable storage reader device through a USB connector or any other type of connector. The downloading operation can also be performed in a wireless fashion.

EXAMPLES

Table 1 compares milling assays performed with a conventional milling device (MF-6 sieve mill, provided by Frewitt SA), and the milling device 1 according to the above embodiments. More particularly, essays were performed with the milling device 1 with the rotor assembly 4 comprising six regularly spaced blades 11 and having a diameter of 160 mm. The blades 11 had a square shape and were oriented such that, when the rotor assembly 4 is mounted in the milling unit 2, one of their edges faced the screen 22. The screen 22 used had a mesh size of 1.0 mm×0.63 nm mesh with square wire mesh. Milling essays were carried by feeding the milling chamber 16 with 30 kg of agglomerated sea salt having a bulk density of 1.03 g/ml. The milling operation was performed during a milling time of 1 min.

During the milling operation, the rotor assembly 4 was rotated with a peripheral speed varied between 500 and 560 mm/s, corresponding to a rotation speed RS comprised between about 60 and 67 rpm. The rotor assembly 4 was also subjected to an oscillating movement with an oscillation angle varied between 90° and 180°, and the oscillation frequency was varied within values comprised between 58 and 111 oscillations/min, or Hz. The oscillating movement of the rotor assembly 4 was also shifted with a shift angle varied between 0 and 20°.

Table 1 reports flow rate of the milled materials obtained with the conventional milling device and with the milling device 1 of the invention.

TABLE 1

| | Run # | RS mm/S | OF $min^{-1}$ | OA ° | SA ° | Flow rate kg/h |
|---|---|---|---|---|---|---|
| MF-6 | 1 | 530 | 100 | 93 | 0 | 213 |
| milling device | 1 | 500 | 111 | 90 | 1 | 208 |
| 1 | 2 | 500 | 58 | 180 | 1 | 240 |
| | 3 | 500 | 58 | 180 | 20 | 258 |
| | 4 | 500 | 111 | 90 | 20 | 259 |
| | 5 | 560 | 84 | 135 | 20 | 275 |

In table 2, the flow rate of the milled materials obtained with the milling device 1 of the invention is reported for several parameters including the shift angle SA, oscillation angle OA, the rotation speed RS, the average particle size D50, and the change in temperature ΔT of the product, measured before milling and after completion of the milling process. Also reported in table 2 are the fine particles FP, or the percentage of particles having a size below 10% the screen mesh size, and the uniformity index UI of the sea salt material being milled. Here, the uniformity index UI contains information about the particle size distribution of the material being milled by relating the particle size D90 to the particle size D10 multiplied by 100 (100*D10/D90).

The results reported in table 2 show that the milling kinetics, or flow rate of the milled material, increases with increasing the oscillation angle CA and rotation speed RS of the rotor assembly 4. Moreover, inversing the shift angle SA can significantly increase the flow rate. For example, for a shift angle SA of 20°, the flow rate can be increased from 208 to 259 kg/h for the same rotation speed RS (compare for example Run 1 and 4 of milling device 1 in Table 1). Increasing the oscillation angle OA also decrease the measured temperature ΔT. Varying the shift angle allows for distributing forces acting along the rotor periphery during the milling operation and results in a more even wear along the periphery of the rotor assembly 4 and a better controlled milling operation. Consequently, the milling device 1 with the rotor assembly 4 operated with the varying

TABLE 2

| Run # | SA ° | OA ° | RS mm/S | Rotor speed | Flow rate kg/h | D50 mm | FP % | UI | ΔT ° C. |
|---|---|---|---|---|---|---|---|---|---|
| 1 | 1 | 90 | 500 | 111 | 208 | 0.56 | 2.50 | 16.5 | 5.6 |
| 2 | 1 | 90 | 1350 | 210 | 385 | 0.50 | 1.60 | 16.4 | 5.5 |
| 3 | 1 | 180 | 500 | 58 | 240 | 0.51 | 1.80 | 16.4 | 4.4 |
| 4 | 1 | 180 | 1350 | 127 | 442 | 0.56 | 0.60 | 17.4 | 4.6 |
| 5 | 20 | 180 | 500 | 58 | 258 | 0.52 | 0.80 | 17.3 | 5.4 |
| 6 | 20 | 180 | 1350 | 127 | 461 | 0.54 | 2.60 | 16.1 | 3.7 |
| 7 | 20 | 90 | 500 | 111 | 259 | 0.52 | 4.80 | 15.2 | 3.4 |
| 8 | 20 | 90 | 1350 | 210 | 401 | 0.60 | 5.90 | 15.2 | 2 |
| 9 | 10 | 135 | 920 | 126 | 349 | 0.52 | 5 | 15.2 | 5.9 |
| 10 | 10 | 135 | 560 | 84 | 275 | 0.51 | 5.20 | 15.1 | 6 |
| 11 | 10 | 135 | 1290 | 155 | 420 | 0.52 | 5.60 | 14.8 | 6.6 |
| 12 | 10 | 105 | 920 | 155 | 319 | 0.53 | 2 | 16.7 | 5.9 |
| 13 | 10 | 165 | 920 | 105 | 378 | 0.53 | 1.40 | 16.7 | 4.7 |
| 14 | 2 | 135 | 920 | 126 | 340 | 0.54 | 5.20 | 15.1 | 7.9 |
| 15 | 19 | 135 | 920 | 126 | 352 | 0.53 | 0.60 | 17.4 | 6.9 |

oscillation angle OA and possibly shift angle SA as described above allows for a better particle size distribution during the milling operation.

In an embodiment, the rotor assembly 4 is oscillated with an oscillation angle OA of 2° or less, substantially corresponding to the rotor assembly 4 being vibrated. This excitation mode of the rotor assembly 4 can be useful to help the milled material to pass through the screen assembly 13 by declogging the milled material. This excitation mode of the rotor assembly 4 can be used, for example, at, or towards, the end of the milling operation. Moreover, the tendency toward sticking of the milled material can be reduced by effecting the rotor movements by alternating the rotation speed RS or by varying the oscillation angle OA, and/or by shift angle SA greater than zero.

The above parameters can be adjusted depending on the material to be milled, i.e., depending on the size distribution of the material particles, temperature, and flow rate to be achieved. In contrast to a conventional oscillating milling devices where the oscillation angle cannot be varied, the milling device 1 allows for increasing the oscillation angle OA while decreasing the peripheral speed of the rotor assembly 4. This yields an equivalent flow rate but allows diminishing the increase in temperature during the milling process, since the peripheral velocity is lower than in the conventional machine.

The milling device 1 disclosed herein guarantees optimum sizing results plus excellent flow rates. The oscillating rotor movement, ensuring constant, uniform speed and force effect gentle sizing of the product. The advantage of this process resides in an exceptionally low fine particle fraction in the end product, as well as being capable of processing heat sensitive products.

REFERENCE NUMBERS

1 milling device
2 milling unit
3 housing
4 rotor assembly
5 rotor shaft
6 wall
7 end disc
8 spoke
9 bushing
10 arcuate recesse
11 blade
12 spline bushing inner periphery
13 screen assembly
14 front door
15 bushing arrangement
16 milling chamber
17 outlet funnel
18 rod
19 latch portion
20 drive unit
21 o-ring seal
22 screen
23 screen support structure
24 ribs
25 apertures
26 flanges
27 pin
28 slot
30 motor drive module
31 control module
32 sensor
33 curve D90
34 curve D50
35 curve D10
OA oscillation angle
OF oscillation frequency
RS rotation speed
SA shift angle

The invention claimed is:

1. A milling device for performing a milling operation comprising:

a milling unit comprising a housing defining a milling chamber that can be filled with a material to be milled, a rotor assembly rotatably mounted in the housing, and a screen assembly extending below the rotor assembly, wherein the screen assembly serves for fractionating the material milled by the rotor assembly in movement;

a drive unit adapted for controlling the movements of the rotor assembly relative to the screen assembly during the milling operation;

a sensor configured to measure properties of the material being milled during the milling operation; and a control module adapted to determine and adjust milling parameters during the milling operation in accordance with the properties of the material measured by the sensor, such that said controlling the movement of the rotor assembly is performed during the milling operation in accordance with the properties of the material.

2. The milling device according to claim 1, wherein said movements of the rotor assembly comprise an oscillating movement having an oscillation angle that can be varied during the milling operation.

3. The milling device according to claim 2, wherein said drive unit is further configured such that the oscillating movement comprises an oscillation frequency that can be varied during the milling operation.

4. The milling device according to claim 2, wherein said drive unit is further configured such that said oscillation angle can be shifted by a shift angle at each oscillation during the milling operation.

5. The milling device according to claim 4, wherein said shift angle can be varied during the milling operation.

6. The milling device according to claim 1, wherein said drive unit is further configured to produce a rotational movement of the rotor assembly with a rotation speed that can be varied during the milling operation.

7. The milling device according to claim 1, wherein said drive unit is further configured to produce a translational movement of the rotor assembly and/or the screen assembly such that the distance between the rotor assembly and the screen assembly can be varied during the milling operation.

8. The milling device according to claim 1, wherein the sensor is a multi-parameter sensor configured to determine a parameter using laser spatial filter velocimetry.

9. The milling device according to claim 1, wherein the drive unit further comprises a motor control unit connected to the control module for driving the rotor assembly.

10. The milling device according to claim 1, wherein the sensor is mounted in the milling chamber.

11. A milling device for performing a milling operation comprising:

a milling unit comprising a housing defining a milling chamber that can be filled with a material to be milled, a rotor assembly rotatably mounted in the housing, and a screen assembly extending below the rotor assembly, wherein the screen assembly serves for fractionating the material milled by the rotor assembly in movement;

a drive unit adapted for controlling the movements of the rotor assembly relative to the screen assembly during the milling operation;

a sensor configured to measure properties of the material being milled during the milling operation, wherein the properties of the material being milled which the sensor measures comprise at least one of particle size distribution, number of particles, flow rate, and temperature; and a control module adapted to determine and adjust milling parameters during the milling operation in accordance with the properties of the material measured by the sensor, such that said controlling the movement of the rotor assembly is performed during the milling operation in accordance with the properties of the material.

* * * * *

UNITED STATES PATENT AND TRADEMARK OFFICE

CERTIFICATE OF CORRECTION

PATENT NO. : 9,289,776 B2
APPLICATION NO. : 13/736302
DATED : March 22, 2016
INVENTOR(S) : Virdis et al.

It is certified that error appears in the above-identified patent and that said Letters Patent is hereby corrected as shown below:

In the specification:

Column 8, line 8: please delete the word "nm" and replace it with --mm--

Column 8, line 55: please delete the word "CA" and replace it with --OA--

Signed and Sealed this
Twenty-eighth Day of June, 2016

Michelle K. Lee

Michelle K. Lee
*Director of the United States Patent and Trademark Office*